US007107913B2

(12) United States Patent
Smith

(10) Patent No.: US 7,107,913 B2
(45) Date of Patent: Sep. 19, 2006

(54) MODULAR TERRAIN ASSEMBLY

(76) Inventor: Paul Smith, 3653 Jennifer St., San Diego, CA (US) 92117

( * ) Notice: Subject to any disclaimer, the term of this patent is extended or adjusted under 35 U.S.C. 154(b) by 354 days.

(21) Appl. No.: 10/656,035

(22) Filed: Sep. 5, 2003

(65) Prior Publication Data

US 2005/0051061 A1 Mar. 10, 2005

(51) Int. Cl.
*A47B 57/00* (2006.01)

(52) U.S. Cl. ..... 108/64; 108/65

(58) Field of Classification Search ..... 108/64, 108/65, 59, 152, 108, 54.1; 52/7, 36.1, 79.1, 52/6, 127.9, 582.2, 585, 593
See application file for complete search history.

(56) References Cited

U.S. PATENT DOCUMENTS 2,596,663 A * 5/1952 Duffy ..... 108/69
2,851,311 A * 9/1958 Gibbs ..... 108/64
3,103,185 A * 9/1963 McGuirk ..... 108/64
4,104,835 A * 8/1978 Bardwick, III ..... 52/7
4,192,083 A * 3/1980 Rebbeck ..... 108/64
4,694,962 A * 9/1987 Taub ..... 108/54.1
5,035,186 A * 7/1991 Uredat et al. ..... 108/64
5,069,408 A * 12/1991 Bessinger ..... 108/108
5,809,905 A * 9/1998 John et al. ..... 108/64
5,848,497 A * 12/1998 Henderson ..... 52/36.1
6,349,507 B1 * 2/2002 Muellerleile ..... 52/36.5

FOREIGN PATENT DOCUMENTS

JP 2002250142 A * 9/2002

* cited by examiner

*Primary Examiner*—Jose V. Chen

(57) ABSTRACT

A modular terrain assembly generally provides cooperating modular boards. Each board has a worksurface on a base, with the base elevated on legs. A tongue along an edge of one board is received into a groove along the edge of an adjacent board, thereby enabling a unified worksurface. The tongue and groove arrangement further includes alignment members for a more precise arrangement.

20 Claims, 5 Drawing Sheets

MODULAR TERRAIN ASSEMBLY

BACKGROUND

The field of the present invention is modular terrain assembly systems. More particularly, the invention relates to module terrain boards useful for modeling, hobby, and craft work.

Many people enjoy hobby, craft, or art projects. Often these projects consume considerable space, and would benefit from a dedicated work area or worksurface. It is desirable that such a project worksurface facilitate assembling and working on the project, while also providing an aesthetically pleasing and convenient display surface. Such a worksurface preferably would provide a sturdy support for the project, craft, or art project, since such projects often entail building sophisticated terrain models or attaching heavy structures. Also it would be desirable that the worksurface flexibly expand as a project proceeds. For example, a project may begin as a relatively simple and small endeavor, and grow both in complexity and size over time. In this regard, the worksurface may need to expand into an available space to accommodate the expanding project.

For many people, living space is limited and therefore an expansive hobby worksurface may interfere with daily living. Accordingly, it would be desirable that a worksurface easily disassemble into component parts for storage, and then be easily reassembled at a later time. Since the hobby, craft, or art project may have a complex construction, it is important that the worksurface accurately realign upon reassembly. For example, a worksurface having train tracks, electrical lines, and terrain structures typically needs to be reassembled with a high degree of alignment accuracy to avoid unnecessary and difficult realignment of tracks, structures, and infrastructure. It would also be desirable that the worksurface be portable. Often those involved in hobbies, crafts, or arts desire to move their worksurface for public display, or transport their worksurface so that a group or club may work together on the project. Although numerous hobby worksurfaces are known to be available, none has satisfactorily addressed the needs of hobbyists, crafters, and artists.

SUMMARY

Briefly, the present invention provides a modular terrain assembly having cooperating modular boards. Each board has a worksurface on a base, with the base elevated on legs. A tongue along an edge of one board is received into a groove along the edge of an adjacent board, thereby enabling a unified worksurface. The tongue and groove arrangement further includes alignment members for a more precise arrangement.

In a preferred example of the modular terrain assembly, at least some of the modular boards are square, with grooves along two edges, and tongues along the other two edges. The tongues have tabs that are received into holes in the grooves for accurate board alignment. Since the tongues and grooves extend along a substantial portion of each board, the boards may be offset from each other, thereby enabling flexible worksurface shapes. A backdrop piece may be received into the groove of a board, thereby providing a vertical surface at the end of the unified worksurface. To further enhance flexibility, boards may be provided in other shapes and sizes. The boards may also integrate full or partial terrain structures, such as mountains, houses, or trees.

Advantageously, the modular terrain assembly allows for flexible construction arrangements, while still enabling easy disassembly and compact storage. Also, the modular terrain assembly may be accurately aligned, so reassembly is simplified. Further, the modular assembly arrangement provides a stable and elevated base, with sufficient open volume for easy routing of cables, wires, lines, or pipes, for example. These and other advantages will become apparent by review of the figures and detail descriptions that follow.

DETAILED DESCRIPTION

Figure 1:
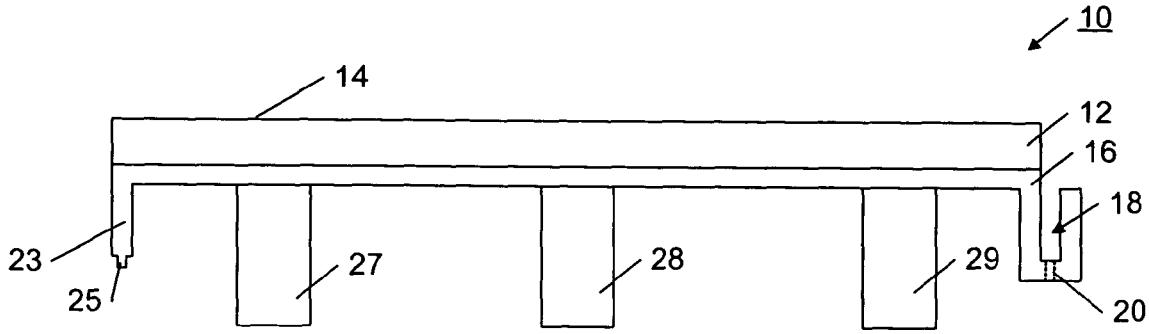
FIG. 1 is cross-sectional side view of a modular board for use in a modular terrain assembly in accordance with the present invention.

Referring now to FIG. 1 a modular board for a modular terrain assembly is illustrated. The modular board 10 is shown in a cross sectional side view. The modular board 10 cooperates with other similar modular boards to construct a unified worksurface for hobby, craft, or modeling work, for example. Each modeling board has a top 12 that provides a worksurface 14. In one example, the top 12 is a soft foam or foam rubber substance providing a cushioned worksurface for the hobbyist or modelist. Alternatively, the top 14 may be more rigid, such as an expanded polystyrene (EPS) or similar rigid or semi-rigid foam. In another example, the top 14 may be constructed of cork, wood, or other surface suitable for hobby, craft, or modeling work. It will be appreciated that the worksurface may also be painted or covered with a paper, cloth, aggregate, or sand, for example.

The top 12 is attached to a base 16. The base 16 is preferably semi-rigid for providing a stable and supportive base for the top 12. The base 16 is elevated above a support surface by legs, such as legs 27, 28 and 29. By elevating base 16, sufficient open space is made available beneath the base for routing wires, cables, lines, pipes or other infrastructure systems for the hobby, craft, or model. The base 16 is constructed with a tongue and groove system for interconnecting multiple modular boards. A tongue 23 may be positioned along one edge of the modular board 10, while a groove 18 may be positioned along another edge. The tongue 23 and the groove 18 each have alignment members, such as protrusion 25 and hole 20, for facilitating easy and accurate alignment of modular boards.

Advantageously, the modular terrain board 10 enables flexible and expandable construction arrangements, while still enabling easy disassembly and compact storage. Also, the modular terrain board 10 may be accurately aligned, so reassembly is simplified. Further, the modular assembly arrangement provides a stable and elevated base, with sufficient open volume for easy routing of cables, wires, lines, or pipes, for example. The modular board 10 also provides a sturdy worksurface for creating an aesthetically pleasing project.

Figure 2:
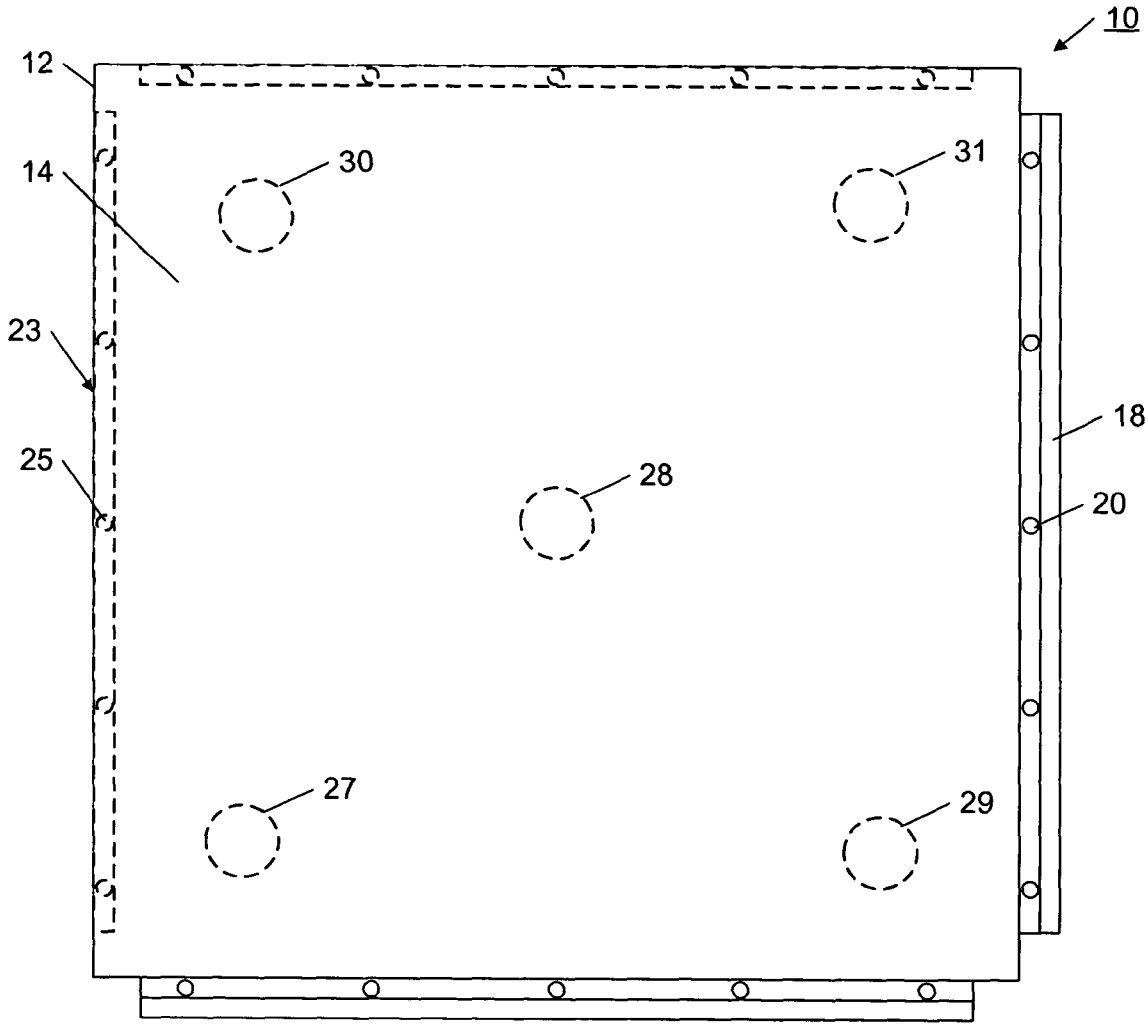
FIG. 2 is a top view of a modular board for use in a modular terrain assembly in accordance with the present invention.

As shown in FIG. 2, a modular board 10 may be constructed with a substantially square top 12. Two adjacent edges are provided with tongue systems, such as tongue 23, while the other two adjacent edges are provided with groove systems, such as groove 18. It will be appreciated that other arrangements of the tongue and groove edges may be provided. In a particularly stable and flexible arrangement, each tongue and groove extends along substantially the full length of an edge of the modular board 10. For example, groove 18 is an elongated groove extending substantially the full length of one edge of modular board 10. In a similar way, tongue 23 is an elongated tongue extending the substantial length of the opposite edge of modular board 10. It will be appreciated that the tongue or groove may also be constructed in spaced apart sections.

Elongated tongue 18 has holes 20 equally spaced along its length. In a similar manner, elongated tongue 23 has protrusions 25 equally spaced along its length. Holes 20 are sized and positioned to cooperatively mate with corresponding protrusions, thereby facilitating accurate alignment of adjacent modular boards. Modular board 10 is shown with five supporting legs, such as legs 30 and 31. It will be appreciated that more or fewer legs could be used depending upon the specific size and intended application for the modular board. For example, large modular boards intended for large scale railroad modeling would require more leg support as compared to smaller modular boards intended for small scale modeling.

In one example of modular board 10, the base 16, the tongue 23, and the groove 18 are integrally formed, preferably using an injected molded plastic method. Such a construction provides a particularly sturdy and light construction for many modeling, craft, and hobby purposes. It will also be appreciated that the legs need be integrally formed with the base, or may be detachably connected. Also, it will be appreciated that protrusion 25 may be a tab, ball, or other shape. Further, protrusion 25 may include tapers for assisting in properly seating into its associated hole alignment member.

Figure 3:
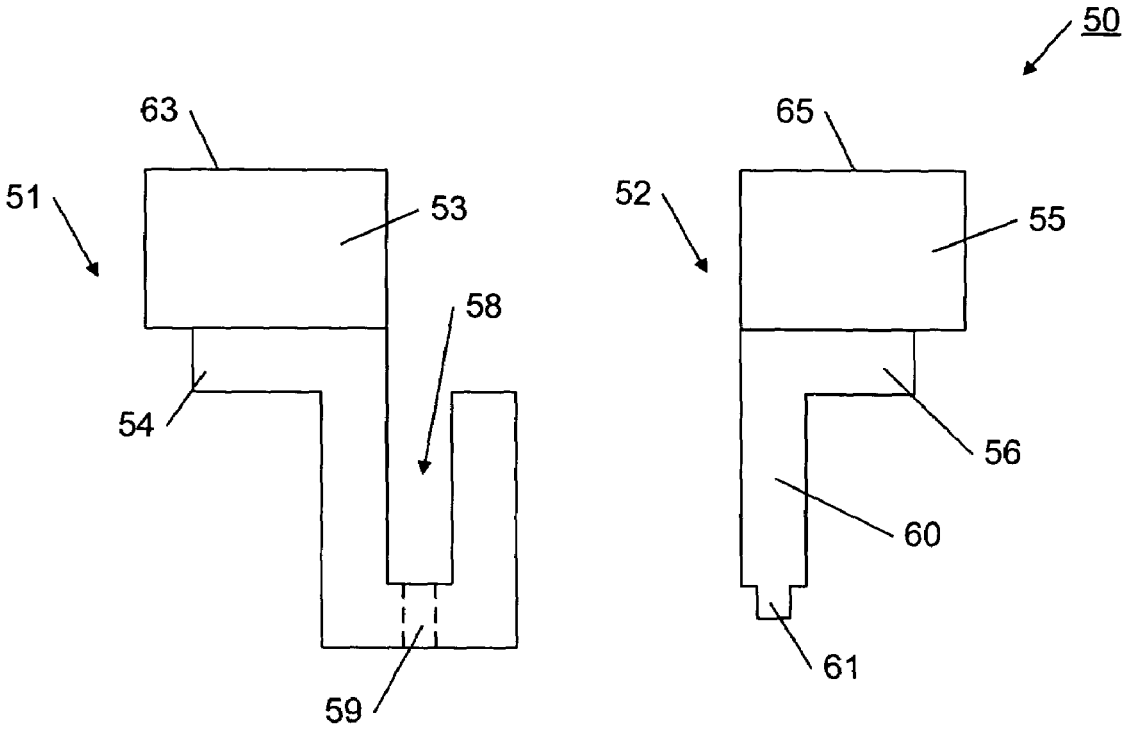
FIG. 3 is a partial cross-sectional view of a tongue arrangement and a groove arrangement for use with a modular terrain board and assembly in accordance with the present invention.

Referring now to FIG. 3 an expanded view of a tongue and groove attachment system is shown. Tongue and groove attachment system 50 includes a groove assembly 51 on a first modular board, and a tongue assembly 52 on another modular board. Tongue assembly 52 has a base 56 integrally formed with a tongue 60. Tongue 60 also has an integrally formed alignment protrusion 61 or series of alignment protrusions. It will be appreciated that the number of alignment protrusions may be equal or less than the number of alignment holes provided in a corresponding groove. The base 56 has a top 55 that provides a first worksurface 65. The tongue 60 is located directly below the top 55. In this way, the edge of the top 55 is substantially collinear with an edge of the tongue 60.

The groove assembly 51 has a base 54 that provides a generally U-shaped structure for providing a groove 58. Holes 59 or other alignment members are provided at the base of the groove 58 for receiving the alignment member from the tongue. It will be appreciated that the holes may be constructed as through-holes, as illustrated, or may be constructed as a hollow or other depression in the base material. The base 54 is attached to a top 53, which has a worksurface 63. The groove 58 is beneath the top 53 but is offset to facilitate receiving the tongue assembly.

Figure 4:
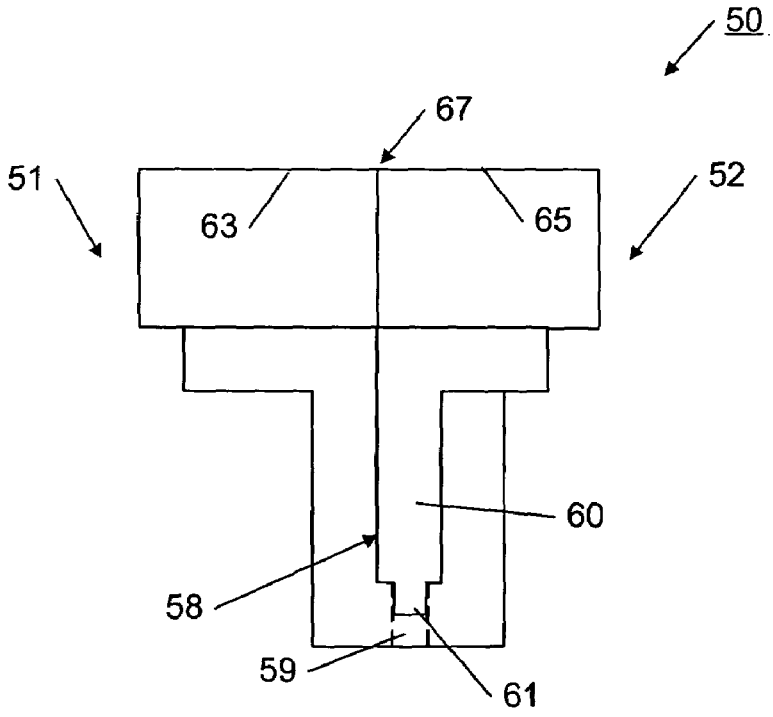
FIG. 4 is a partial cross-sectional view of a tongue arrangement and a groove arrangement for use with a modular terrain board and assembly in accordance with the present invention.

Referring now to FIG. 4 the tongue and groove assemblies of FIG. 3 have been coupled. Accordingly, the tongue 60 has been received into groove 58, and alignment protrusion 61 has been received into hole 59. It will be appreciated that the tongue and groove system may be frictionally received for highly accurate placement, but may be more loosely received for less critical applications. When coupled, the tongue and groove system position the top 53 adjacent to top 55, thereby combining worksurface 63 and worksurface 65 to form a unified worksurface 67.

Figure 5:
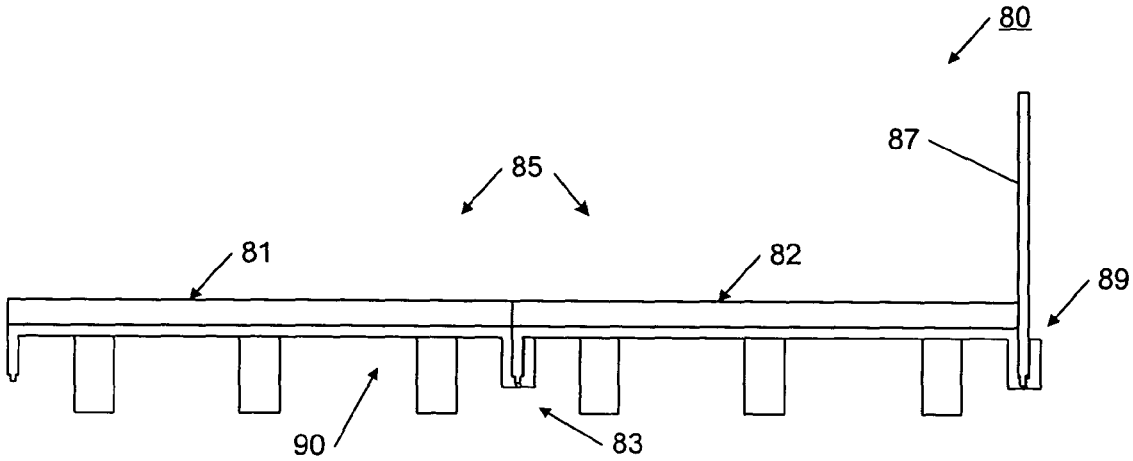
FIG. 5 is a cross-sectional side view of a modular terrain assembly in accordance with the present invention.

Referring now to FIG. 5, a cross-sectional side view of a modular terrain assembly is shown. Modular terrain assembly 80 includes a first modular board 81 and second modular board 82. The first modular board 81 has a groove assembly mating with the tongue assembly of second modular board 82. The tongue and groove attachment system 83 securely and accurately positions the top of the first board 81 adjacent to the top of the second modular board 82, thereby forming a unified worksurface 85. Since each of the modular boards is elevated above its respective support surface on legs, a work volume 90 is available directly beneath the base. This work volume 90 is ideal for routing electrical wires, cables, lines, plumbing, or other infrastructure support for structures on the worksurface. In this way, such infrastructure may be hidden from view to provide a more aesthetically pleasing worksurface environment. Further enhancing aesthetics, a backdrop 87 may be positioned at the edge of unified worksurface 85. Backdrop 87 has a tongue received into the groove assembly 89 of modular board 82. Vertical backdrop 87 provides an aesthetically pleasing end to the unified worksurface 85, and may be used for painted backdrops or mosaics, supporting edge structures, or simply as an aesthetically pleasing edge piece. Backdrop 87 may also be fitted with an attached worksurface to facilitate attaching hobby or craft items.

Figure 6:
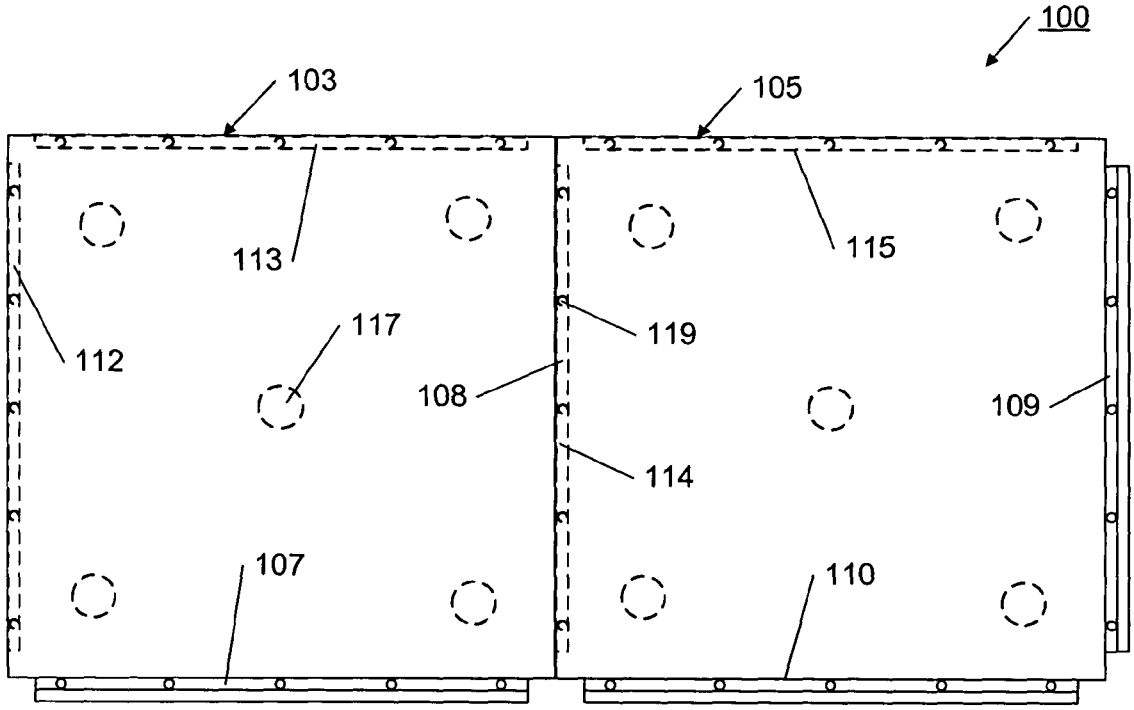
FIG. 6 is a top view of a modular terrain assembly in accordance with the present invention.

Referring now to FIG. 6, a modular system 100 is illustrated. Modular system 100 includes a first modular board 103 attached to an adjacent second modular board 105. First modular board 103 has groove assemblies 107 and 108 while the second modular board 105 has groove assemblies 109 and 110. In a similar manner, the first modular board 103 has tongue assemblies 112 and 113 while the second modular board has tongue assemblies 114 and 115. As described earlier, each of the tongue and groove assemblies is elongated and extends substantially along the entire edge of the board. Such an elongated structure provides a particularly stable attachment mechanism for modular boards. It will be appreciated that either or both the tongue and groove may be elongated, and also may be constructed in spaced apart sections. Each of the modular boards is elevated above its support surface by legs such as leg 117. In modular system 100, the elongated tongue 114 from modular board 105 is received into the groove assembly 108 of modular board 103. In this way, the top surfaces of the adjacent boards cooperate to form a unified worksurface. To facilitate even more accurate alignment, alignment protrusions in the tongue 119 are received into alignment holes in groove 108. As shown in FIG. 6, each of the modular boards 103 and 105 is shaped as a square, with the two modular boards cooperating to form a rectangular unified worksurface.

Figure 7:
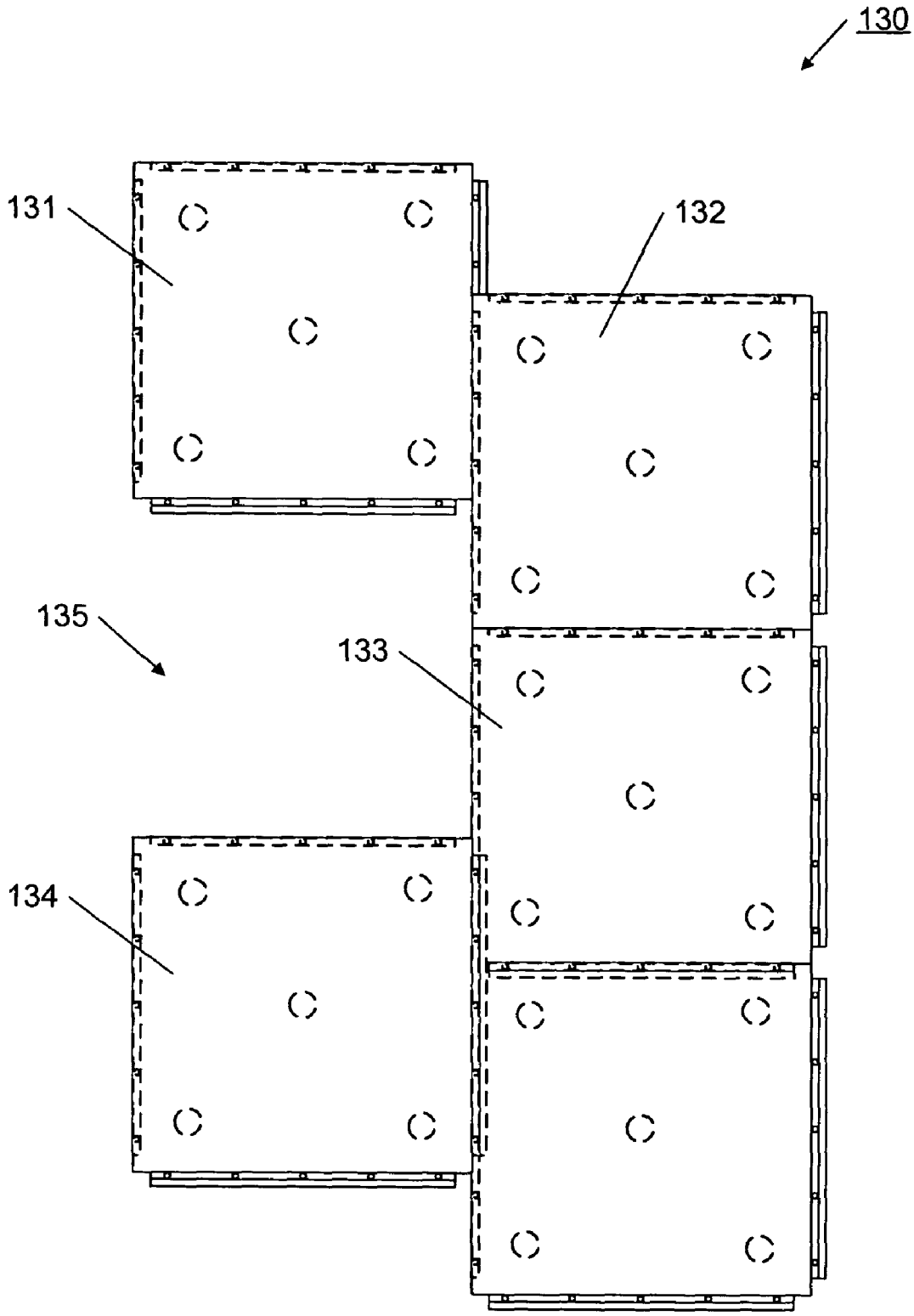
FIG. 7 is a top view of multiple modular terrain assemblies in accordance with the present invention.

However, the tongue and groove arrangement of the modular boards provides for more flexible worksurface geometries. For example, FIG. 7 shows that the tongue and groove systems provide for offset coupling of adjacent modular boards. Modular system 130 has modular boards 131, 132, 133, and 134. Since the protrusion members of the tongue and groove systems are equally spaced, the alignment members facilitate accurate alignment of the modular boards, even when offset. For example, modular board 131 is shown with a groove having five alignment holes along its right edge. Modular board 132 is coupled to modular board 131 in an offset manner. More particularly, only three of the alignment tabs of the top left tongue of board 132 mate with the three alignment holes at the bottom right of modular board 131. In this way, two alignment holes in modular board 131 are not used, while two alignment protrusions of board 132 are not used in coupling board 131 to 132. Stated otherwise, the modular board 131 is coupled to board 132 using only three offset alignment members. In a similar way, modular board 134 is offset from board 133, thereby providing an open space 135. It may be useful, for example, to provide an open space to enable the unified worksurface to extend around a physical obstacle such as a pole or building support. In another example, such an offset modular arrangement enables a more flexible geometric arrangement of the unified worksurface.

Figure 8:
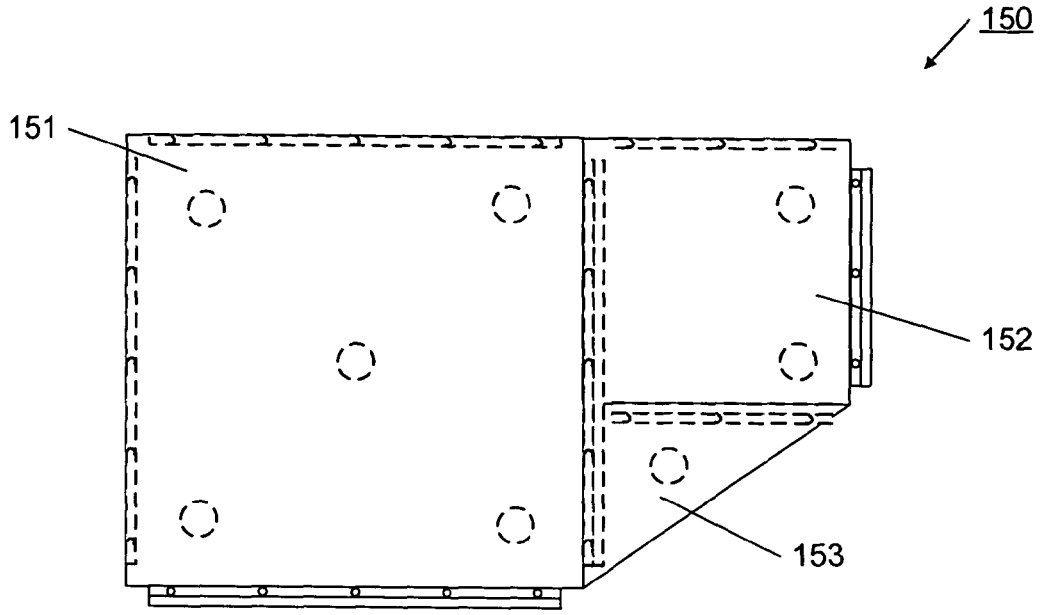
FIG. 8 is a top view of multiple modular terrain assemblies of various sizes and shapes in accordance with the present invention.

Although the modular board has been generally described to be square, it will be appreciated that other geometric shapes may be used. For example, referring to FIG. 8, a modular system 150 is illustrated. Modular system 150 includes a square modular board 151 coupled to a smaller square modular board 152. Even though modular board 152 is smaller than board 151, the size of the tongue and the spacing of the alignment members is consistent with the larger board to enable board 151 and board 152 to securely couple and cooperate to form a unified worksurface. In a similar manner, triangular board 153 is shown connected to two alignment members of board 151 and connected to three alignment members on board 152. Although board 153 does not include a groove on its hypotenuse, it will be appreciated that such a groove assembly could be provided. Accordingly, it will be appreciated that modular boards may be provided in different sizes and different shapes to support flexible and varied worksurface requirements.

Figure 9:
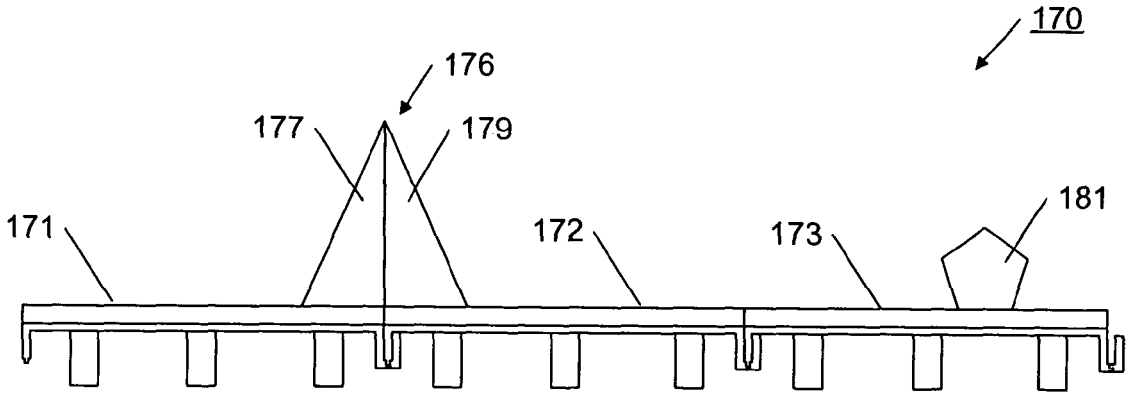
FIG. 9 is a cross-sectional side view of a modular terrain assembly with generic attached terrain features in accordance with the present invention.

Referring now to FIG. 9, another modular system 170 is shown. Modular system 170 includes three modular boards, board 171, board 172, and board 173. As described above, each modular board includes a tongue and groove assembly for securing attaching adjacent modular boards. Modular system 170 shows that modular boards may include integrally formed terrain structures or portions of terrain structures. For example, modular board 171 includes the left half of a mountain 177, while modular board 172 includes the right half of a mountain 179. Accordingly, when modular board 171 is coupled to modular board 172 using the tongue and groove assemblies discussed earlier, mountain 176 is formed. It will be appreciated that other terrain structures may be used. In another example, modular board 173 has an integrated building 181. In this way, modular boards may be easily assembled and arranged to provide varied terrain and topological features, including buildings or other structures.

While particular preferred and alternative embodiments of the present intention have been disclosed, it will be appreciated that many various modifications and extensions of the above described technology may be implemented using the teaching of this invention. All such modifications and extensions are intended to be included within the true spirit and scope of the appended claims.

What is claimed is:

1. A modular terrain assembly, comprising:

a first modular board having a first worksurface and a first base;

legs connected to the first base and elevating the first base from a support surface;

a tongue connected to an edge of the first base;

alignment protrusions connected to and extending from the tongue, the alignment protrusions being spaced apart;

a second modular board having a second worksurface and a second base;

legs connected to the second base and elevating the second base from a support surface;

a groove along an edge of the second base, the groove constructed to receive the tongue;

alignment holes in the groove, the holes constructed to receive the alignment protrusions; and wherein when the tongue is aligned in the groove, the first worksurface and the second worksurface cooperate to form a unified and elevated worksurface.

2. The modular terrain assembly of claim 1, wherein the tongue is an elongated tongue extending substantially along the length of the edge of the first base.

3. The modular terrain assembly of claim 1, wherein the tongue is integrally formed with the first base.

4. The modular terrain assembly of claim 1, wherein the groove is an elongated groove extending substantially along the length of the edge of the second base.

5. The modular terrain assembly of claim 1, wherein the groove is integrally formed with the second base.

6. The modular terrain assembly of claim 1, wherein the first base further comprises a groove along another edge of the first base.

7. The modular terrain assembly of claim 1, wherein the first modular board is square.

8. The modular terrain assembly of claim 1, wherein the first modular board is a triangle.

9. The modular terrain assembly of claim 1, wherein the first modular board has a different geometric shape as compared to the second modular board.

10. The modular terrain assembly of claim 1, wherein the first modular board has a different size as compared to the second modular board.

11. The modular terrain assembly of claim 1, further comprising:

a backdrop piece;

a tongue along an edge of the backdrop piece;

wherein the backdrop tongue is constructed to be frictionally received into the groove of the second base.

12. The modular terrain assembly of claim 1, further comprising a terrain structure on the first worksurface.

13. The modular terrain assembly of claim 1, further comprising a first partial terrain structure on the first worksurface and a second partial terrain structure on the second worksurface, wherein the first and second partial terrain structures cooperate to form a terrain structure on the unified worksurface.

14. The modular terrain assembly of claim 1, wherein the legs are integrally formed with the bases.

15. The modular terrain assembly of claim 1, wherein the first base, tongue, and legs are integrally formed.

16. The modular terrain assembly of claim 1, wherein the worksurface is detachably received on the base.

17. A modular terrain assembly board, comprising:

a base;

a worksurface on a top side of the base;

a tongue connected to an edge of the base;

alignment members connected to and extending from the tongue, the alignment members being spaced apart;

a groove along another edge of the base;

cooperating alignment members in the groove; and legs connected to the base and elevating the base from a support surface.

18. The modular terrain assembly board of claim 17, wherein the base, tongue, groove, and legs are integrally formed.

19. The modular terrain assembly board of claim 17, wherein the tongue is directly below the worksurface.

20. The modular terrain assembly board of claim 17, wherein the groove is below and offset from the worksurface.

* * * * *